US006662708B2

(12) United States Patent
Hosny

(10) Patent No.: US 6,662,708 B2
(45) Date of Patent: Dec. 16, 2003

(54) PNEUMATIC ACTUATOR CANISTER

(75) Inventor: Diaa M. Hosny, Palos Verdes Estates, CA (US)

(73) Assignee: Honeywell International Inc., Morristown, NJ (US)

( * ) Notice: Subject to any disclaimer, the term of this patent is extended or adjusted under 35 U.S.C. 154(b) by 113 days.

(21) Appl. No.: 10/090,193

(22) Filed: Mar. 4, 2002

(65) Prior Publication Data

US 2003/0164089 A1 Sep. 4, 2003

(51) Int. Cl.[7] ..... F01B 19/00
(52) U.S. Cl. ..... 92/98 R; 92/101
(58) Field of Search ..... 92/98 R, 101, 92/161, 168, 169.1

(56) References Cited

U.S. PATENT DOCUMENTS

| | | | | |
|---|---|---|---|---|
| 2,478,575 A | * | 8/1949 | Fitch | 92/101 |
| 3,575,088 A | * | 4/1971 | Bauer | 92/98 R |
| 4,056,043 A | | 11/1977 | Sriramamurty et al. | |
| 4,403,538 A | * | 9/1983 | Rise | 92/168 |
| 4,582,466 A | * | 4/1986 | Szczupak | 415/150 |
| 4,893,474 A | | 1/1990 | Miller et al. | |
| 4,918,924 A | | 4/1990 | Kyoya et al. | |
| 5,155,048 A | | 10/1992 | Williams et al. | |
| 5,172,552 A | | 12/1992 | Elpern et al. | |
| 5,487,273 A | | 1/1996 | Elpern et al. | |
| 5,586,744 A | | 12/1996 | Smith et al. | |
| 5,727,447 A | | 3/1998 | Shiraishi et al. | |
| 5,746,058 A | | 5/1998 | Vertanen | |
| 5,937,833 A | | 8/1999 | Kapich | |
| 6,109,167 A | | 8/2000 | Vertanen | |
| 6,155,048 A | * | 12/2000 | Vertanen | |

FOREIGN PATENT DOCUMENTS

| | | |
|---|---|---|
| GB | 2 319 828 A | 6/1998 |
| GB | 2 322 164 A | 8/1998 |

* cited by examiner

*Primary Examiner*—Edward K. Look
*Assistant Examiner*—Igor Kershteyn
(74) *Attorney, Agent, or Firm*—Ephraim Starr

(57) ABSTRACT

A pneumatic actuator canister body employs a press fit cup received over an end portion of the canister to engage mounting studs extending through apertures in the end wall of the body and an end plate internally engaging the end wall. Heads of the studs are constrained between the end plate and a piston plate for the internal actuator spring.

10 Claims, 3 Drawing Sheets

PNEUMATIC ACTUATOR CANISTER

FIELD OF THE INVENTION

This invention relates generally to the field of pneumatic actuators and, more particularly, to a canister employing a closely fitting end cup receiving the canister body housing the actuator.

BACKGROUND OF THE INVENTION

Pneumatic actuators are used for various duties where relatively high reaction speed, simple devices are needed for linear or cable actuation. One such use has been the control of wastegates and variable nozzle devices for turbochargers. Numerous designs exist for such actuators including those disclosed in U.S. Pat. No. 4,893,474 TURBOCHARGER WITH DUAL FUNCTION ACTUATOR, U.S. Pat. No. 5,172,552 TURBOCHARGER WITH FLEXIBLE CABLE WASTEGATE OPERATING LINKAGE, U.S. Pat. No. 5,487,273 TURBOCHARGER HAVING PNEUMATIC ACTUATOR WITH PILOT VALVE, U.S. Pat. No. 5,746,058 ADJUSTABLE ACTUATOR FOR A TURBOCHARGER, U.S. Pat. No. 5,787,591 TURBOCHARGER ACTUATOR WITH ROLLING O-RING, U.S. Pat. No. 6,155,048 ACTUATOR FOR A TURBOCHARGER.

A typical configuration for a prior art actuator is shown in FIG. 1. The actuator has a canister 10 having a cylindrical body 12 and an end wall 14. A spring 16 engaging a piston 18 which is covered by and/or attached to a diaphragm 20 to linearly position a rod 22 to provide the actuating mechanism. The actuator canister incorporates a end cap 24 which includes a fitting 26 for attachment of the pneumatic source. The end cap is crimped to the canister body in a joint 28 which also constrains and seals the peripheral circumference of the diaphragm. The spring is constrained opposite the piston by a spring plate 30. The end wall of the canister is strengthened with a plate 32 inserted between the end wall and spring plate. The spring plate also constrains the seal 34 surrounding the rod.

Attachment of the canister to a bracket or other mounting means is accomplished using studs 36 which are held in a mounting plate 38. The mounting plate is welded to the end wall, either with a continuous circumference weld or with spot or projection welds. In operation, the actuator is subjected to significant cyclical loads which result in a high risk of fatigue in the weld or canister wall resulting in cracking and failure of the actuator.

It is, therefore, desirable to have an actuator canister which eliminates the required welding of a mounting plate to the end wall, both for elimination of the fatigue cracking failure mode and as a cost reduction by elimination of the welding requirement.

SUMMARY OF THE INVENTION

A pneumatic actuator containing the present invention incorporates a canister body having a substantially cylindrical side wall and an end wall. The end wall has multiple apertures arranged around a central aperture. A spring engages a piston which is attached to a diaphragm and to an actuating rod for pneumatic actuation. The diaphragm is attached to the canister wall for the pneumatic seal and the rod extends through the central aperture.

A cup is sized to closely receive an end portion including the end wall of the canister body. The cup has matching apertures aligned with the apertures in the end wall and a second central aperture through which the rod extends. An end plate is inserted within the canister body and abuts the end wall. The end plate also has apertures aligned with the apertures in the end wall and a central aperture through which the rod extends. Attachment studs having a shank and head provide the means to attach the actuator to a bracket or other support device. The shank of each stud is inserted through one of the multiple apertures in the end plate, end wall and cup and the head engages the end plate.

A spring plate including a substantially circular face engages the heads of the studs to urge the studs against the end plate. An outer cylindrical upset portion of the spring plate engages the spring at a second end and an inner cylindrical portion having a flange extending radially inwardly distal from the face constrains a seal for the rod. The seal rests against the end plate around the central aperture. The inner cylindrical portion of the spring plate constrains the seal radially and the spring plate flange constraining the seal axially in cooperation with the end plate. A standard fitting in the canister end opposite the cup provides a means for supplying pneumatic pressure to the diaphragm.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
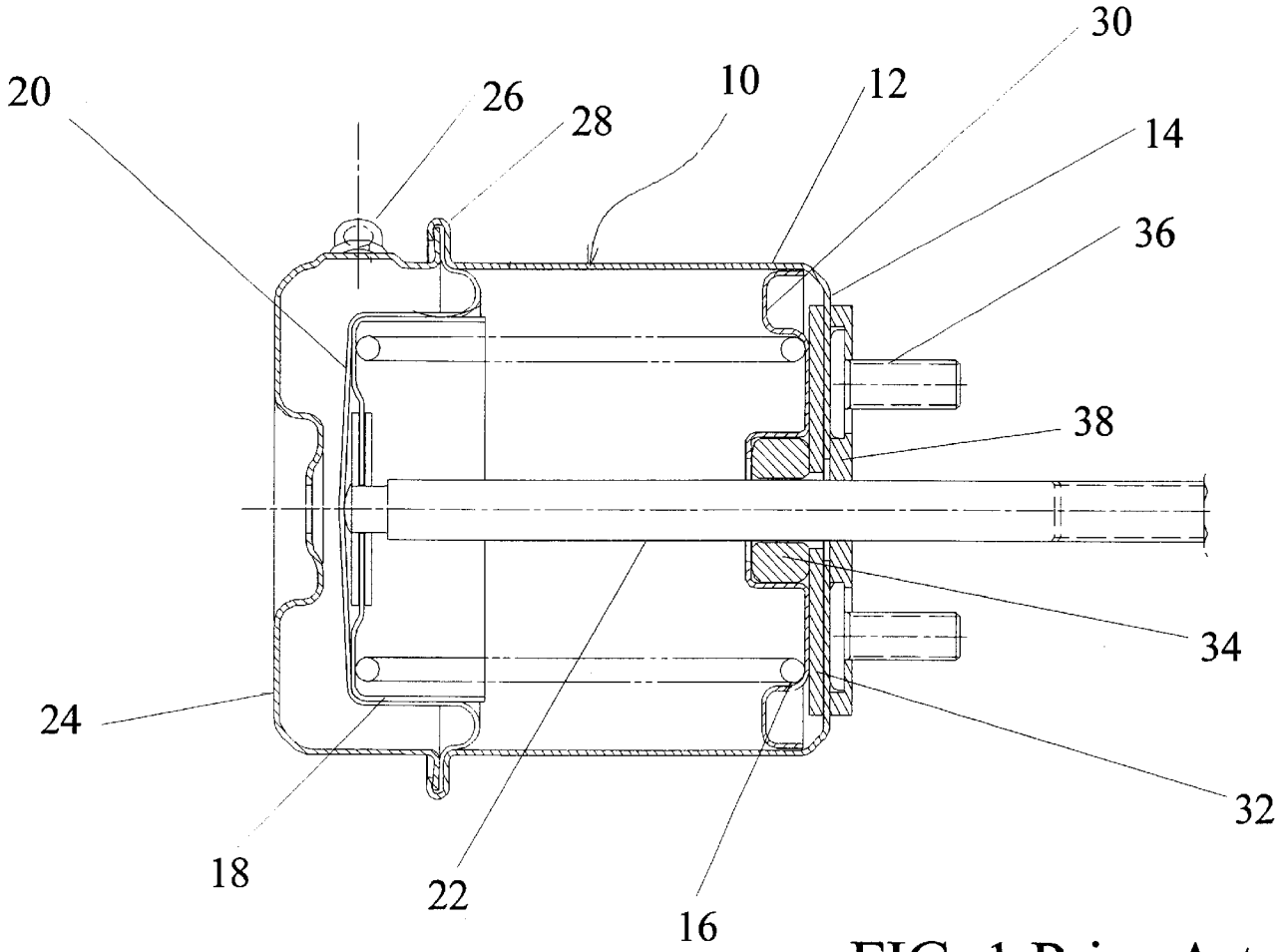
FIG. 1 Prior Art
FIG. 1 is a section view of a prior art pneumatic actuator with a conventional welded canister.
Figure 2:
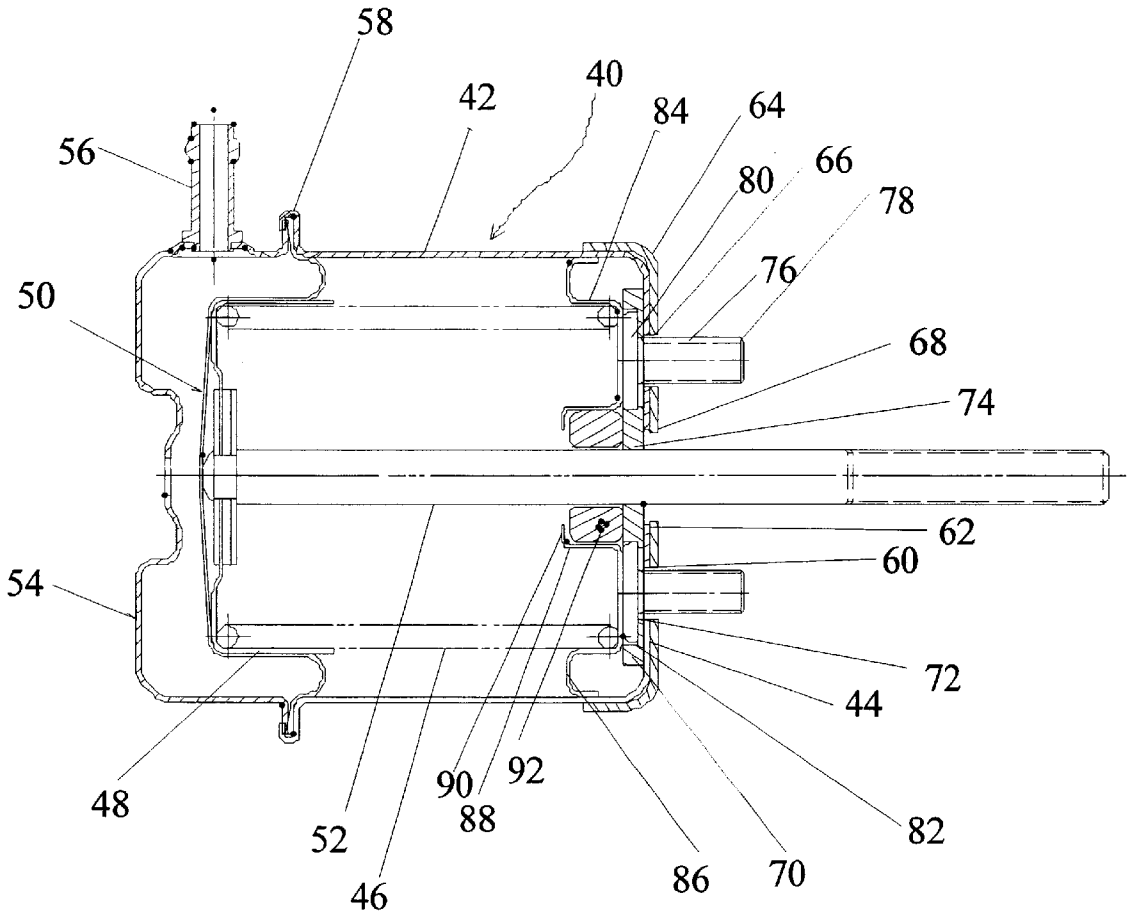
FIG. 2 is a side section view of an actuator employing the present invention with mounting studs; and, FIG. 3 is a pictorial view of an exemplary installation of an actuator incorporating the present invention on a bracket for a turbocharger control device.

Referring to FIG. 2, an embodiment of the actuator incorporating the present invention has a canister 40 having a cylindrical body 42 and an end wall 44. A spring 46 engaging a piston 48 which is covered by and attached to a diaphragm 50 linearly position a rod 52 as the actuating operator in response to pneumatic pressure. The actuator canister incorporates an end cap 54 which includes a fitting 56 for attachment of the pneumatic source. The end cap is crimped to the canister body in a joint 58 which also constrains and seals the peripheral circumference of the diaphragm.

The end wall has multiple holes 60 typically arranged in a circular pattern around the central aperture 62 through which the rod passes. A cup 64 is sized to closely receive an end portion including the end wall of the canister body. The cup has matching apertures 66 aligned with the apertures in the end wall and a second central aperture 68 through which the rod extends. An end plate 70 is inserted within the canister body and abuts the end wall. The end plate also has apertures 72 aligned with the apertures in the end wall and a central aperture 74 for the rod. Attachment studs 76 each having a shank 78 and head 80 provide the means to attach the actuator to a bracket or other support device. The shank of each stud is inserted through one of the multiple apertures in the end plate, end wall and cup and the head engages the end plate. In the embodiment shown, the end plate incorporates a cylindrical relief 82 around each aperture in the plate, which is sized to receive the head of the stud.

The cup is press fit onto the end portion of the canister and for additional strength in certain embodiments is brazed to the cylindrical wall of the body. This brazing operation is significantly simpler that prior art welding requirements and is achieved by locating a ring of brazing material around the canister and the cap with a process step running the canister through a brazing oven.

A spring plate including a substantially circular face 84 engages the heads of the studs to urge the studs against the end plate. In the embodiment shown, the relieved holes receiving the stud heads allow the spring plate to also engage the plate directly to further stabilize the actuating mechanism and the studs. An outer cylindrical upset portion 86 of the spring plate engages the spring at a second end. In the embodiment shown, the upset portion is a channel shape to engage the interior of the cylindrical wall of the canister body to center the spring plate.

The spring plate also includes an inner cylindrical portion 88 having a flange 90 extending radially inwardly opposite from the face of the plate constrains a seal 92 for the rod. The seal rests against the end plate around the central aperture. The inner cylindrical portion of the spring plate constrains the seal radially and the spring plate flange constraining the seal axially in cooperation with the end plate.

Figure 3:
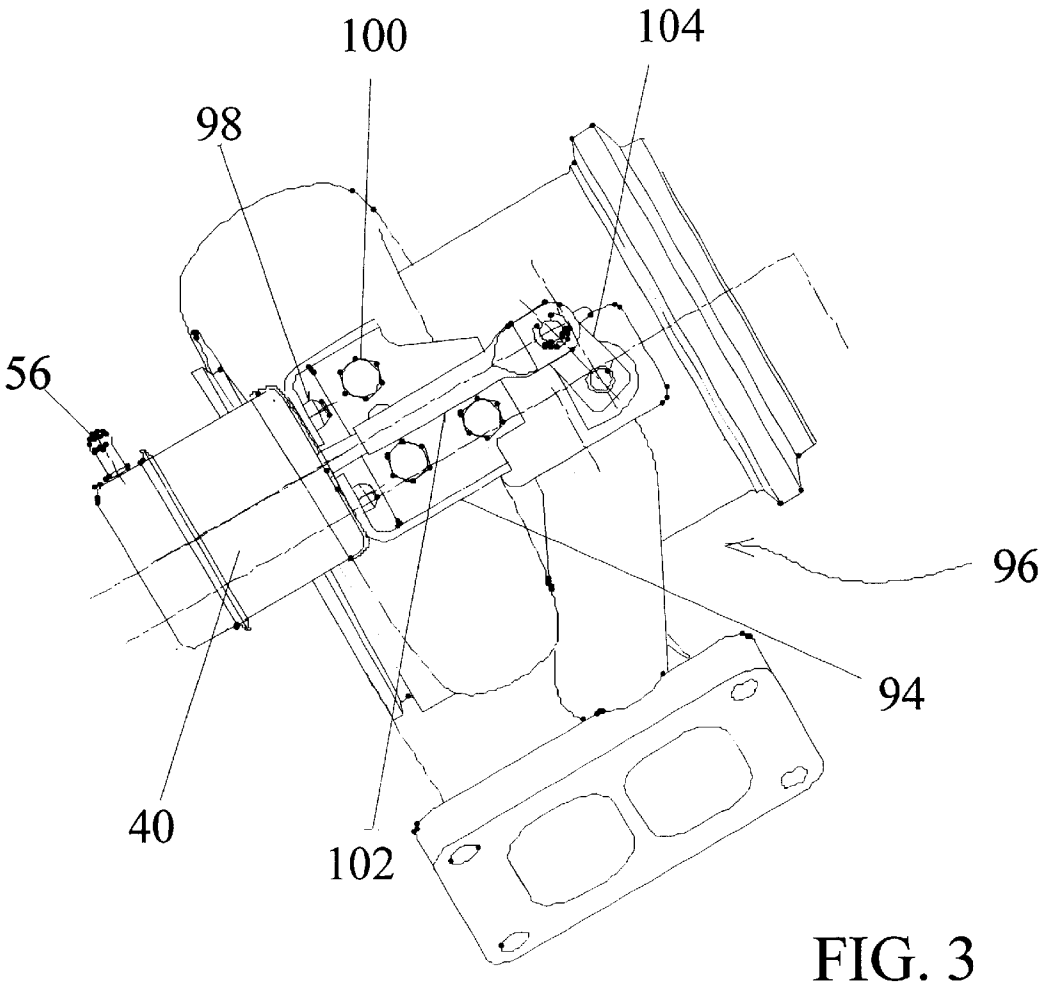

Attachment of the canister to a bracket or other mounting means is accomplished using the studs. As shown in FIG. 3, a mounting bracket 94 for the actuator on a turbocharger 96 engages the studs which can be threaded to accept a nut 98 or the shank can be fixed with star retainers or other frictional retainers. The bracket is, in turn, connected to the case of the turbocharger with bolts 100. An extension 102 connects the actuating rod through a linkage 104 to the turbocharger wastegate mechanism.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A pneumatic actuator comprising:

a canister body having a substantially cylindrical side wall and an end wall, the end wall having a plurality of apertures and a first central aperture;

a spring engaging a piston at a first end, the piston operably attached to a diaphragm and to an actuating rod, the diaphragm sealingly attached to the canister wall and the rod extending through the first central aperture;

a cup sized to closely receive an end portion including the end wall of the canister, the cup having a plurality of apertures aligned with the apertures in the end wall and a second central aperture through which the rod extends;

an end plate received within the canister body and abutting the end wall, the end plate having a plurality of apertures aligned with the apertures in the end wall and a third central aperture closely receiving the rod;

a plurality of attachment studs having a shank and head, the shank of each stud received through one of the plurality of apertures in the end plate, end wall and cup, the head engaging the end plate;

a spring plate including a substantially circular face engaging the heads of the studs to urge the studs against the end plate, an outer cylindrical upset portion engaging the spring at a second end and an inner cylindrical portion having a flange extending radially inwardly distal from the face;

a seal closely receiving the rod and abutting the end plate proximate the third central aperture, the inner cylindrical portion of the spring plate constraining the seal radially and the spring plate flange constraining the seal axially in cooperation with the end plate; and means for supplying pneumatic pressure to the diaphragm.

2. A pneumatic actuator as defined in claim 1 wherein the end plate further includes a cylindrical relief around each of the plurality of apertures sized to closely receive the stud heads, the spring plate further engaging the end plate proximate each cylindrical relief to further constrain the stud heads.

3. A pneumatic actuator as defined in claim 1 wherein the spring plate includes a flange extending outwardly from the outer cylindrical upset portion to engage the side wall for centering the spring plate.

4. A pneumatic actuator as defined in claim 1 wherein the cup is press fit to the side wall of the body.

5. A pneumatic actuator as defined in claim 1 wherein the cup is brazed to the side wall of the body.

6. A pneumatic actuator comprising:

a canister body having a substantially cylindrical side wall and an end wall, the end wall having a plurality of apertures and a first central aperture;

a spring engaging a piston at a first end, the piston operably attached to a diaphragm and to an actuating rod, the diaphragm sealingly attached to the canister wall and the rod extending through the first central aperture;

a cup sized to closely receive an end portion including the end wall of the canister, the cup having a plurality of apertures aligned with the apertures in the end wall and a second central aperture through which the rod extends;

means for stiffening the end wall received within the canister body and abutting the end wall, the stiffening means having a plurality of apertures aligned with the apertures in the end wall and a third central aperture closely receiving the rod;

a plurality of attachment means each received through one of the plurality of apertures in the stiffening means, end wall and cup, the attachment means restrained by the stiffening means;

a means for engaging the attachment means to urge the attachment means against the stiffening means, and engaging the spring at a second end;

means for sealing the rod and operably engaging the stiffening means proximate the third central aperture; and means for supplying pneumatic pressure to the diaphragm.

7. A pneumatic actuator as defined in claim 6 wherein the stiffening means comprises an end plate received within the canister body and abutting the end wall.

8. A pneumatic actuator as defined in claim 7 wherein the plurality of attachment means comprise studs having a shank and head, the shank of each stud received through one of the plurality of apertures in the end plate, end wall and cup, the head engaging the end plate.

9. A pneumatic actuator as defined in claim 8 wherein the engaging means comprises a spring plate including a substantially circular face engaging the heads of the studs to urge the studs against the end plate, an outer cylindrical upset portion engaging the spring at a second end and an inner cylindrical portion having a flange extending radially inwardly distal from the face.

10. A pneumatic actuator as defined in claim 9 wherein the sealing means comprises a substantially torroidal seal closely receiving the rod and abutting the end plate proximate the third central aperture, the inner cylindrical portion of the spring plate constraining the seal radially and the spring plate flange constraining the seal axially in cooperation with the end plate.

* * * * *